United States Patent [19]

Orr

[11] Patent Number: 4,521,834

[45] Date of Patent: Jun. 4, 1985

[54] ADJUSTABLE REFLECTOR FOR ILLUMINATING DEVICES

[76] Inventor: Allie E. Orr, 103 Stonewall Rd., Warner Robins, Ga. 31093

[21] Appl. No.: 547,973

[22] Filed: Nov. 2, 1983

[51] Int. Cl.[3] ..... F21V 33/00

[52] U.S. Cl. ..... 362/139; 362/202; 362/208; 362/283; 362/281; 362/277; 362/306; 362/341

[58] Field of Search ..... 362/139, 202, 208, 255, 362/277, 281, 283, 306, 341

[56] References Cited

U.S. PATENT DOCUMENTS

| | | | |
|---|---|---|---|
| 2,036,567 | 4/1936 | Cannon | 362/281 |
| 2,082,857 | 6/1937 | Thoroughgood | 362/208 |
| 2,137,881 | 11/1938 | Margulies | 362/202 |
| 4,039,818 | 8/1977 | Hickman | 362/184 |

*Primary Examiner*—Donald P. Walsh

[57] ABSTRACT

There is disclosed an adjustable light reflector to be used in combination with an illuminating device for the purpose of reflecting light into almost any desired direction which comprises of a hood having a reflective surface on the underside of the top surface, said top surface having arms attached on either side, said arms extending downward and each arm having a rotatable attaching means receiver and latch receiving means on the lower end; a collar means having made thereupon two rotatable attaching means, each said means being rotatably engaged with a rotatable attaching means receiver; an illuminating device casing having latch means, hood receiving means and a collar means receiver, said collar means receiver positioned near the light emitting end and concentric to the longitudinal axis of the said illuminating device casing, the collar means receiver to rotatably receive the collar means, the latch means to engage the latch receiving means and the hood receiving means to receive the hood.

21 Claims, 14 Drawing Figures

ADJUSTABLE REFLECTOR FOR ILLUMINATING DEVICES

FIELD OF INVENTION

This invention relates to improvements in adjustable reflectors and more particularly to adjustable reflectors that may be combined with an illuminating device.

CROSS REFERENCE TO RELATED APPLICATIONS

Another invention by this inventor, titled "DEVICE HOLDER", U.S. Pat. No. 4,208,703, is concerned with a flashlight having built-in tripod support means that allows the flashlight to be prepositioned to illuminate a desired area without having to be hand held. A combining of the adjustable reflector invention with the above described flashlight, would improve the performance of that flashlight, as will be defined later. This is not to say, however, that the application of the adjustable reflector invention is limited to the above described flashlight, or to similar types.

DISCUSSION OF PRIOR ART

Heretofore, illuminating devices having adjustable light reflectors encompassed many various designs, including reflectors that were slideably adjustable, adjustable in one axis, multi-axis adjustable, such as ball and socket mounted reflectors, and many other configurations, but none had as many features as this invention, and, in order to avoid repetition, these features are listed as objects and may be seen by referencing the OBJECTS section of this application.

OBJECTS

It is an object of this invention to provide a combination illuminating device and adjustable reflector, wherein the reflector is adjustable on two axes, the axes being generally perpendicular to each other, with the axis of one being rotatable around the other, on the axis of the other, all of which taken together, provides the capability to reflect light in almost any direction without having to reposition the illuminating device. This feature is particularly applicable to portable illuminating devices that have built-in support or attaching means such as magnets, clips, support legs, etc. in that the reflector will provide a means for the device to reflect light into directions that the beam can't be pointed towards because of inherent design limitations in device movement or interferring obstacles in the area of device placement.

Another object is to provide an adjustable reflector that is capable of being placed in a stow position when not in use, remaining attached to the illuminating device, and at the same time imposing no restriction on the normal light emitting capability of the device. For example, if a flashlight was equipped with this invention and it was desired to use the flashlight in the normal manner, the reflector would be placed in the stow position, out of the way and protected.

Another object is to provide a reflector that when in stow position, the reflective surface is not exposed, thereby protecting it from defacement, smudge, etc.

Still, another object is to provide an adjustable reflector mechanism that, when in stow position, adds nothing to the illuminating device length and only a minimal amount to the overall device size, thereby ensuring device compactness.

Still, a further object is to provide an adjustable reflector that, when in stow position, physically conforms closely to the illuminating device in order to prevent large gaps that may allow introduction of foreign objects that could cause damage, which is especially important if the device is stored in a tool box, or the like.

Another object is to provide an adjustable reflector mechanism having a superior shading means in order to prevent the user's eyes from direct contact with the reflective surface, thereby avoiding glare.

Another object is to provide a reflector mechanism that is quickly and easily detached or reattached as required for cleaning, maintenance etc. The mechanism simply snaps on or off the illuminating device.

Another object is to provide a reflector having a surface that may be flat, convex, concave or other contours such that light rays from the illuminating device may be reflected in some predetermined arrangement or pattern.

Another object is to provide a reflector that may be tinted a particular color. For example, a red tinted reflector would serve to reflect a warning light.

Still another object is to provide an adjustable reflector that is of simple and yet rugged design.

Further objects and advantages of the invention will become apparent from a consideration of the drawings and ensuing description there of.

DETAIL DESCRIPTION OF DRAWINGS

FIG. 1 is a perspective view of an illuminating device having magnetic attaching means and equipped with the invention in use.

FIGS. 2*a*–2*c* are operational drawings showing some positions of the invention.

Figures 8A, 8B, 8C, 9A, 9B:
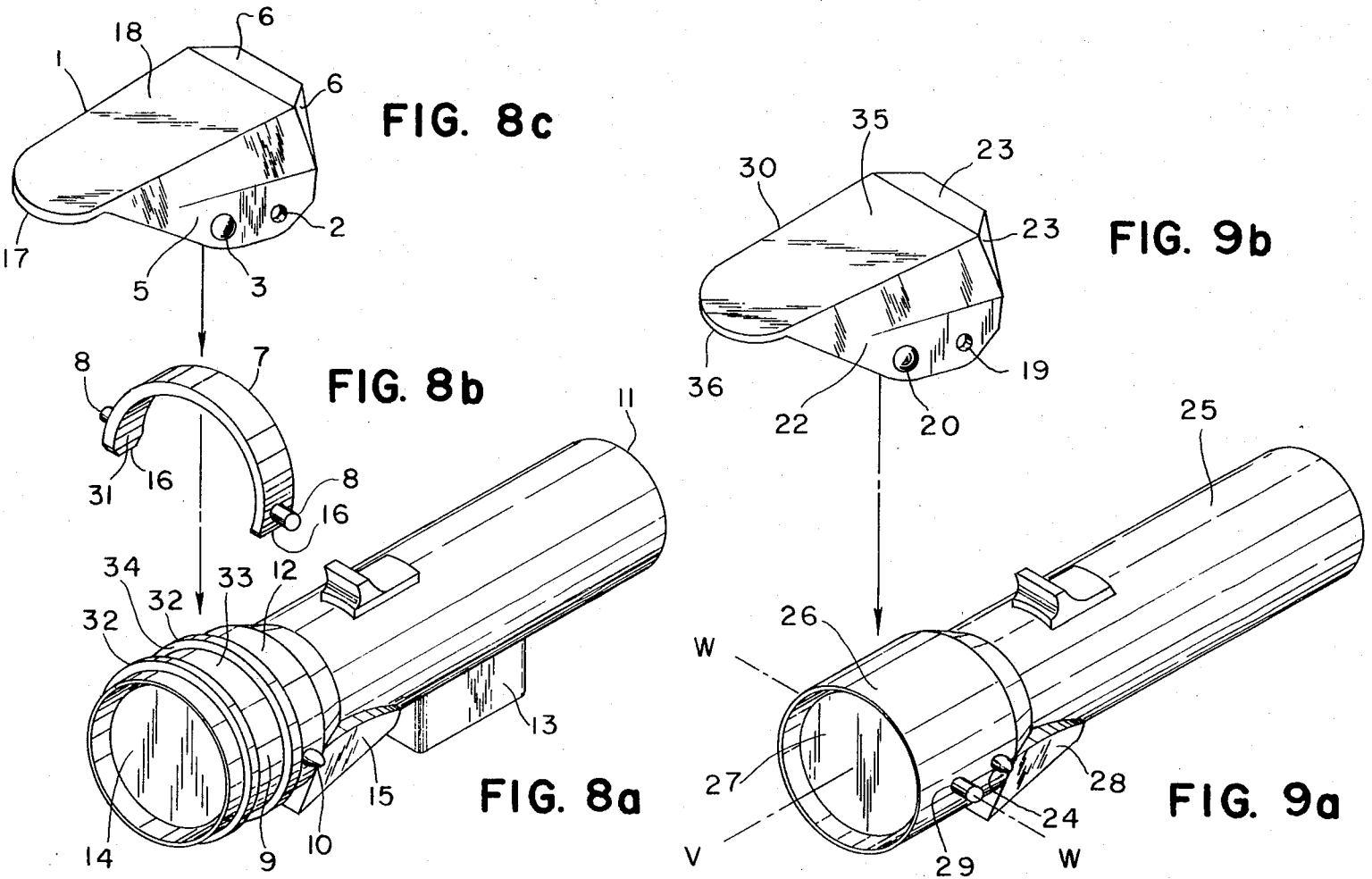

FIGS. 8*a*–8*c* is a disassembled perspective view of the invention showing how the parts fit together.

FIGS. 9*a*–9*b* is a disassembled perspective view of an alternative form of the invention.

DETAILED DESCRIPTION OF INVENTION

This invention is termed adjustable reflector, and basically, may be used in combination with any illuminating device for the purpose of positionally directing light into a desired direction. For example, the illuminating device could be an outside building light in combination with this invention which could be adjusted to illuminate a particular section of the building and then, if desired, the reflective surface could be readjusted to illuminate another section without having to move the building light. The preferred embodiment is, however, a combination of this invention and a flashlight, including flashlights with built-in support, attaching or positioning means and as such, for the remainder of the description herein it will be assumed that the invention is in this combination. However, in accordance with the previous discussion, this is not a necessity.

As a means of establishing forward and rearward directions along the longitudinal axis of the illuminating device (11), it will be assumed, henceforth, that the front end of the said device is the end from whence light rays are emitted and that the rear end, of course, is the opposite end.

The main elements of this invention, as shown in FIG. 8*a*–8*c* are the hood (1), collar means (7) and collar means receiver (9). The hood (see FIG. 8*c*) includes reflective surface (4) (not visible in FIG. 8*c*) located on the underside of top surface (18), arms (5) attached to either side of the top surface, said arms extending downward from the top surface and each having a rotatable attaching means receiver (2) made onto the lower end. The reflective surface (see FIG. 1) could have any desired contour and be tinted any color, however, in the preferred embodiment, it would be untinted and flat, and in a plane generally parallel to the plane of the top surface.

The collar means (7) may be any circular member, semi-circular member or other device having made thereonto said member or device, two rotatable attaching means (8) such that the resulting configuration (see FIG. 8*b*) allows (a) each said rotatable attaching means to be rotatably and frictionally engaged with a rotatable attaching means receiver (2) so as to provide the hood with rotary movement and position holding capabilities over the collar means on an axis established by a line connecting the rotational centers of each of the two said rotatable attaching means, said axis to be henceforth referred to as the Y axis, and, (b) the said collar means to be rotatably and frictionally engaged over the generally cylindrically shaped collar means receiver (9) so as to provide the collar means with rotary movement and position holding capabilities over the said collar means receiver on an axis generally coincident with the longitudinal axis of the collar means receiver, said longitudinal axis henceforth to be referred to as the X axis. For explainatory purposes, when the hood and collar means are rotatably connected, forming a two element assembly, the said assembly will be henceforth referred to as the collar means/hood assembly.

The collar means receiver (9) (see FIG. 8*a*) is made onto, or attached to, the casing (12) of illuminating device (11). The casing is defined as the outer surface of a portion, or more, of an illuminating device onto which elements of this invention are attached, or made a part thereof, in order to create the combination adjustable reflector and illuminating device. The collar means receiver is generally cylindrical in shape in order to allow reception of and rotary movement of the collar means over the said receiver.

The basic invention is provided when the hood is rotatably but frictionally attached to the collar means and, in turn, the collar means is rotatably but frictionally attached over the collar means receiver whereby the hood is rotatable about the collar means on the Y axis and the collar means is rotatable over the collar means receiver on the X axis, thereby effectively providing the reflective surface (4) rotational capabilities on both the X and Y axes, wherein the X and Y axis are seperate axes wherein the frictional but rotational attachment of the hood to the collar means allows the hood to be rotated to some predetermined position on the Y axis and the frictional but rotational attachment of the collar means to the collar means receiver allows the collar means to be rotated to some predetermined position on the X axis, wherein a moving reflective surface will be presented to a portion, or more, of light rays being emitted from the illuminating device light emitting source (14) during some portion, or more, of rotational movement of the hood on the X axis and on the Y axis. It is noteworthy to state that the placement of the rotatable attaching means on the collar means may be such that a Y axis is established that perpendicularly intersects the X axis in which case, when the collar means is rotated over the collar means receiver, the Y axis is rotated around the X axis on an axis of rotation that is coincident with the X axis. However, it should also be noted that it is not a necessity that the placement of the said rotatable attaching means be such that a Y axis is established that intersects the X axis, or if intersection does occur between the two said axes, that this intersection must be perpendicular. The relative positioning and dimensioning of the collar means, hood, rotatable attaching means and receivers and the placement of the collar means receiver on the casing are such that the hood can be rotated on the Y axis between two rotational limits, said limits occurring when the rotating hood contacts the casing, or some member attached thereonto, in a manner to prevent further rotation in that direction of rotation wherein during some portion, or more, of hood rotation between said limits a moving reflective surface will be presented to emitted light rays, wherein also there will be an unlimited rotational capability of the collar means on the X axis wherein at any rotational position of the collar means on the X axis, the hood may be rotated on the Y axis between the said limits as previously discussed, thereby providing an emitted light reflector adjustable on both the X and Y axes In the preferred embodiment of this invention, the collar means (7) is a semi-circular member or split collar which includes two shafts (8) attached thereonto, said shafts acting as rotatable attaching means, wherein the longitudinal axes of each shaft is in alignment with the other such that one line may be coincident with both said longitudinal axes, said line establishing a Y axis. In the preferred embodiment, the rotatable attaching means receiver (2) are bearings made onto the hood arms (5) wherein each said shaft is frictionally engaged into each said bearing in order to provide the hood with both rotary movement and position holding capabilities over the said shafts on the Y axis. In the preferred embodiment, the collar means receiver consists of two lands (32) and a cylindrical groove (33) that are made onto a casing that is also cylindrical, wherein the longitudinal axes of both the groove and casing are generally coincident and is effectively the X axis, wherein the casing generally surrounds the light emitting source (14), wherein the light emitting source is so arranged to emit light rays that are, in the main, in alignment, or coincident, with the X axis, wherein the said lands and groove are located near the front end of the casing, which contains the light emitting source. Wherein each land inner surface (34) lies generally in a plane that is parallel to the other and the two said planes are generally perpendicular to the X axis, and the space between the two land inner surfaces effectively establishes the groove, wherein the lands and groove, in cooperation, form a receiver for the mounting or engagement of the split collar rotatably over the groove and between the lands in such a manner to allow rotatable movement of the split collar over the groove but not allow longitudinal movement of the split collar along the casing. The split collar is constructed of material having spring-like characteristics and, in its natural state, has a diameter somewhat less than the groove diameter, and when engaged with the groove, the angular displacement of the split collar, from one end point (16) to the other end point (16), is somewhat greater than 180°, as measured by using the X axis as the vertex of a moving radius line, said line being perpendicular to the X axis. All of this, taken in combination, affords the split collar with a spring-like frictional grip over the groove which provides the split collar with both rotary movement and position holding capabilities over the groove and on the X axis. In the preferred embodiment, the Y axis may intersect the X axis and, if so, this intersection is generally perpendicular (see FIG. 2*c*), or the Y axis may be displaced away from the X axis. In either case, however, if the split collar is rotated over the groove, the moving Y axis will establish a single stationary plane, wherein said plane will be perpendicularly intersected by the X axis.

Figure 2A:
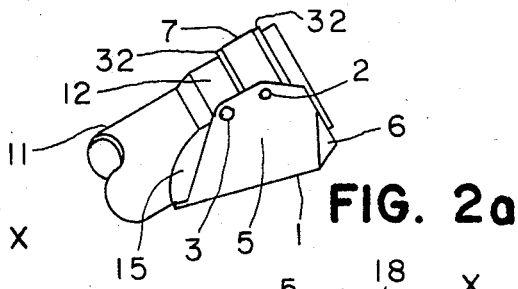
Figure 2B:
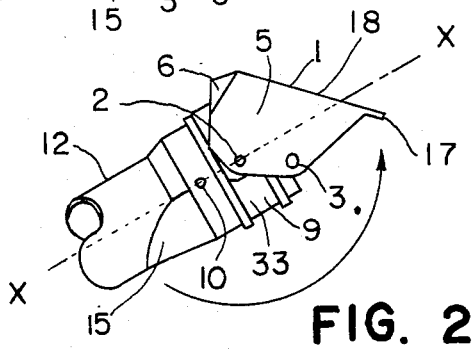
Figure 2C:
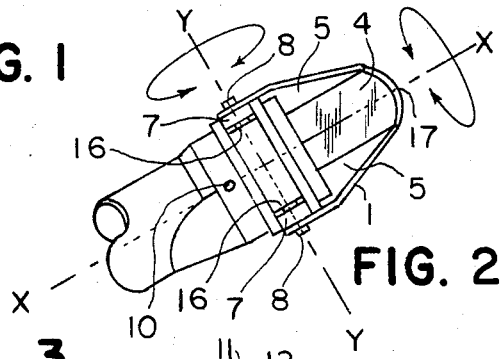
Figure 3:
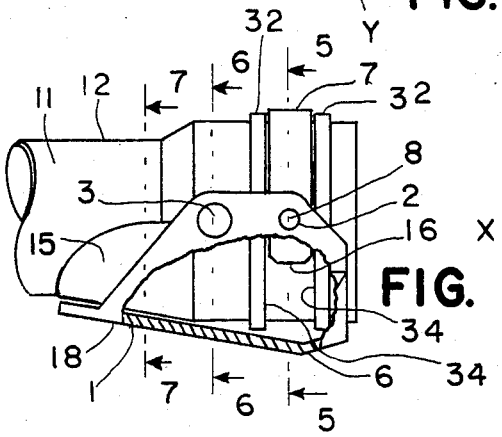
FIG. 3 is a side cut-away view showing how the invention fits the illuminating device when in stow position.
Figure 7:
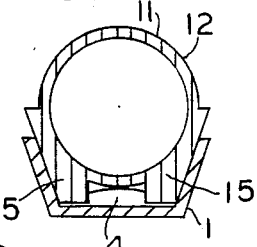
FIG. 7 is a transverse sectional view along the lines 7—7 of FIG. 3.
Figure 4:
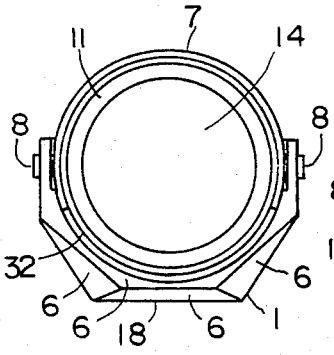
FIG. 4 is a front view of the invention when in stow position.
Figure 5:
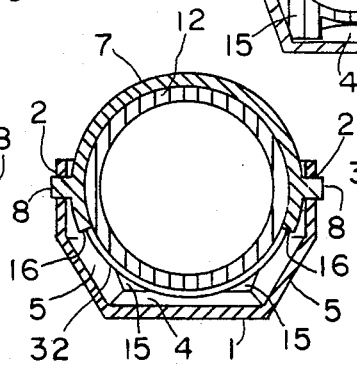
FIG. 5 is a transverse sectional view along the lines 5—5 of FIG. 3.
Figure 6:
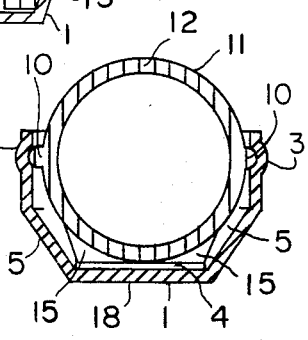
FIG. 6 is a transverse sectional view along the lines 6—6 of FIG. 3.

In the preferred embodiment, the hood may be rotated, on the Y axis, from a closed, or stow, position as shown in FIGS. 2*a*, 3, and 4, which represents one of the previously discussed rotatable limits, to the other limit, in a manner shown in FIG. 2*b*, *l during which time the reflected light rays will travel an arc of about* 180°, from reflecting light to the rear of the illuminating device to a point where the reflective surface ceases to reflect any emitted light because the reflective surface will be generally parallel to the emitted light rays.

Using the split collar as the collar means provides other functions. On occasion, it is desirable to detach the collar means/hood assembly from the device for maintenance purposes or other reasons. The hood is rotated to the approximate position shown in FIG. 2*b*. The collar means/hood assembly is grasped and pulled in a direction generally perpendicular to the X axis so as to allow the split collar ends (16) to travel along the groove and spread increasingly further apart as they cam around the groove. This process will continue until the split collar ends are the maximum distance apart, which is equal to the groove diameter. Further movement upwards results in disengagement of the collar means/hood assembly from the illuminating device. Reattachment of the assembly is a reverse process where the split collar ends are forced down along the groove until total contact is made between the groove and the split collar inner surface (31). The hood is constructed of a material having spring-like qualities, and both arms will follow the spreading movement imposed by the split collar end spread during the above described processes. Also, the disengagement capability of the collar means/hood assembly provides a more durable mechanism in that if the hood is accidently struck while in use, disengagement from the illuminating device may occur rather than breakage.

In the preferred embodiment, the relative positioning and dimensioning of the hood, collar means and collar means receiver are such that when the hood is rotated to the stow position (see FIGS. 2*a*, 3 and 4), which is the position used when the services of the reflector is not required, or when the illuminating device is to be stored, the reflector mechanism conforms closely to the illuminating device in order to hold to a minimum any increase in size of the resulting illuminating device when combined with the said mechanism, and also to prevent any large gaps, or spaces, between the said mechanism and the device to minimize the introduction of foreign objects that could cause damage or mar the reflective surface. The said close conformity is accomplished, in part, by providing the hood with a rear cover (6), which is attached to the hood top surface (18) and portions of each arm (5) that are near the top surface, and also by extending the arms from the rear cover almost to the hood forward tip (17), wherein the arms and rear cover are shaped to conform to the illuminating device. The rear cover and arms, in combination with the hood top surface, also perform another function when the reflector is in use, and that is, they tend to shade the user's eyes from direct contact with the reflective surface, preventing glare. Also, when the hood is in stow position, the reflector mechanism is clear of the emitted light rays, allowing the illuminating device to still be used as an illumination source.

As an optional improvement, the hood may be provided with one or more latch means receivers (3) and the casing with an equivalent number of latch means (10) wherein said latch means and receiver become over-rideably engaged when the hood is rotated on the Y axis into the stow position, thereby providing a means of holding the hood in the stow position until services of the reflector are required at which time, a sufficient rotatable force is applied to overcome the holding force of the latch and the hood is rotated out of the stow position. In the preferred embodiment (see FIGS. 3, 6, 8*a* and 8*c*) the latch means (10) are two rounded protrusions located on either side of the casing (12) and to the rear of the collar means receiver (9), and the latch means receivers (3) are holes, or indentations, in the hood arms (5) and so located that when the hood is in stow position (see FIG. 3), the said protrusions are engaged into the said holes. An over-rideable latching action is provided by a spring-like force applied inwardly by the hood arms and latch receivers as a result of the latch recievers not being as far apart as the latch means. During latching or unlatching, the said holes simply cam over the said rounded protrusions.

As another optional improvement, a hood receiving means (15) may be provided on the casing to receive the hood when the hood is placed into slow position, said means to generally conform to a portion, or more, of the hood so as to provide support and protection to the hood, especially if some tangental or lateral force is accidently applied to the hood, and also to act as a keying member to identify the stow position on the casing. In the preferred embodiment, the hood receiving means is a boss, or flange (15) (see FIGS. 3, 5, 6, 7 and 8*a*) located on the casing to the rear of the collar means receiver, wherein the hood will saddle the flange when in stow position, said flange conforming closely to a portion of the inner sides of both arms (5) and reflective surface respectively, wherein the said flange may extend rearward far enough to be adjacent the hood forward tip (17) so as to provide maximum fit and protection.

At this point, having described the invention, some additional applications not heretofore brought out, seems in order. For example, the illuminating versatility of the invention can be shown by assuming that the illuminating device is somehow suspended in the center of a 20 foot diameter hollow sphere. As the reflective surface (ie, the hood) is rotated on the Y axis, light rays will travel an arc of about 180°, from reflecting light to the rear of the said device to a point where the light beam shines directly out in front of the device, and at any point during the reflective surface Y axis rotation, the reflective surface may also be rotated on the X axis (see FIG. 2*c*), thereby illuminating nearly any given point inside the sphere.

Figure 1:
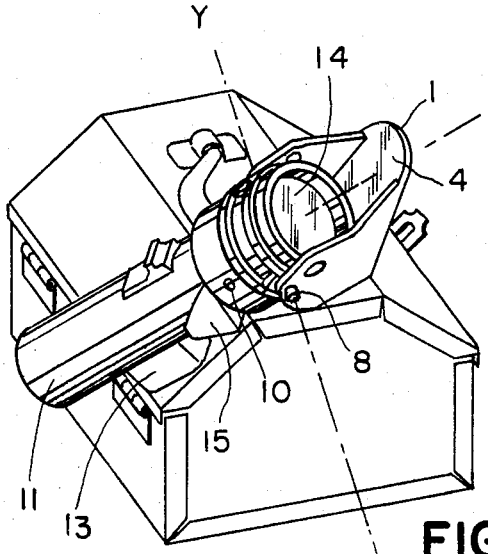

Another example of the advantages of this invention can readily be seen by referring to FIG. 1. Here an illuminating device with built-in magnetic attaching means (13), attached to a metallic surface, can reflect light into almost any direction, whereas if this invention were not utilized, it could only direct a light beam in a direction generally parallel to the surface to which it is magnetically attached.

Illuminating devices that have no special support means are improved when equipped with this invention. For example, a so equipped device could simply be laid on a floor and the reflector mechanism adjusted to direct light into almost any direction without having to be hand held.

An alternative form of the invention is shown in FIGS. 9*a* and 9*b*. From an operational standpoint, the difference distinguishing the alternative form from the main invention is that hood (30) is not rotatable around the casing (26). In fact, if in the main invention, the hood (1) was rotated into the stow position (see FIG. 3) and while in this position, the collar means (7) was glued to the collar means receiver (9), thereby making the collar means and included rotatable attaching means (8) an integral part of the casing (12), the resulting configuration would be that of the alternative form. Actually, in the alternative form, the collar means and receiver have been eliminated and the rotatable attaching means (29) are made onto the casing (26). The advantage of the alternative form is that it is simpler and cheaper and, when used in combination with a hand held illuminating device, sustains no degredation in performance, as compared to the main invention, because simply by rotating the said device, the hood is effectively rotated around the casing. Also, the alternative form could conceivably be used in combination with an illuminating device having a support or attaching means designed such that the device casing could be rotated within the said means, thereby providing the hood rotational capability around the V axis. It is noteworthy to state that hand held illuminating devices equipped with this invention, either in the main or alternative forms, are provided the capability to illuminate obscure places that are difficult to access.

The main element of the alternative form, as shown in FIGS. 9*a* and 9*b* are the hood (30) and rotatable attaching means (29). The hood, which is similar to the hood described in the main invention, includes reflective surface (21) located on the underside of the top surface (35), arms (22) attached to either side of the top surface, said arms extending downward from the top surface and each having a rotatable attaching means receiver (19) made onto the lower end. The reflective surface, which is similar to reflective surface (4) of the main invention as shown in FIG. 1, could have any desired contour and be tinted any color, however, in the preferred embodiment, it would be untinted and flat and in a plane generally parallel to the plane of the top surface.

The two rotatable attaching means (29) are attached, or made onto, the casing (26) of illuminating device (25), each said attaching means to be rotatably and frictionally engaged with a rotatable attaching means receiver (19) so as to provide the hood with rotary movement and position holding capabilities over the said attaching means on an axis established by a line connecting the rotational centers of each of the two said rotatable attaching means, said axis to be henceforth referred to as the W axis.

The basic alternative form of the invention is provided when the hood is rotatably but frictionally attached to the rotatable attaching means wherein the rotatable attaching means are attached to, or made a part thereof, the casing of the illuminating device, whereby the hood is rotatable over the rotatable attaching means on the W axis thereby providing the reflective surface (21) rotational capability on the W axis wherein the frictional but rotational attachment of the hood to the rotatable attaching means allows the hood to be rotated to some predetermined position on the W axis, wherein a moving reflective surface will be presented to a portion, or more, of light rays being emitted from the illuminating light emitting source (27) during some portion, or more, of rotational movement of the hood on the W axis. The relative positioning and dimensioning of the hood, rotatable attaching means receiver and the placement of the rotatable attaching means on the casing are such that the hood can be rotated on the W axis between two rotational limits, said limits occurring when the rotating hood contacts the casing, or some member attached thereonto, in a manner to prevent further rotation in that direction of rotation wherein during some portion, or more, of hood rotation between the said two limits, a moving reflective surface will be presented to the emitted light rays of the illuminating device.

In the preferred embodiment of the alternative form, the rotatable attaching means (29) are two shafts wherein the longitudinal axis of each shaft is in alignment with the other such that one line may be coincident with both said axes, said line establishing a W axis. Also, the rotatable attaching means receiver (19) are bearings made onto the hood arms (22) wherein each said shaft is frictionally engaged into each said bearing in order to provide the hood with both rotary movement and position holding capabilities over the said shafts on the W axis. Also in the preferred embodiment, the casing (26) generally surrounds the light emitting source (27) wherein the longitudinal axis of the casing is hereby defined as the V axis, wherein the light emitting source is so arranged to emit light rays that are, in the main, in alignment, or coincident, with the V axis, wherein the two shafts (29) are located near the front end of the casing, which contains the light emitting source, wherein the shafts are so located on the casing that the W axis may intersect the V axis, in which case the intersection is generally perpendicular, or the W axis may be displaced away from the V axis, in which case the relative orientation of the two said axes are such that if the casing were to be rotated on its V axis, the moving W axis would establish a single stationary plane, said plane being perpendicularly intersected by the V axis.

In the preferred embodiment of the alternative invention, the hood may be rotated, on the W axis, from a closed, or stow position, similarly to the main invention, as shown in FIGS. 2*a*, 3 and 4, which represents one of the previously discussed rotatable limits, to the other limit, in a manner similar to the main invention, shown in FIG. 2*b*, during which time the reflected light rays will travel an arc of about 180°, from reflecting light to the rear of the illuminating device to a point where the reflective surface cease to reflect any emitted light because the reflective surface will ge generally parallel to the emitted light rays. The description of hood (1) of the preferred embodiment of the main invention is identical to hood (30) of the preferred embodiment of the alternative form wherein the hood (30) may be rotated to a stow position and, when in this position, will closely conform to the illuminating device, the said conformity being accomplished in part by providing the hood (30) with a rear cover (23), which is attached to hood top surface (35) and portions of each arm (22) that are near the top surface, and by extending the arms from the rear cover almost to the hood forward tip (36), wherein the arms and rear cover are shaped to conform to the illuminating device. The rear cover and arms, in combination with the hood top surface, also perform the function of shading the user's eyes when the reflector is in use. also, when the hood is in stow position, the reflector mechanism remains clear of the emitted light ray path.

In the alternative form, as an optional improvement, the hood may be provided with one or more latch means receivers (20) and the casing with an equivalent number of latch means (24) wherein the said latch means and receiver become over-rideably engaged when the hood is rotated to the stow position, but may be disengaged by rotating the hood away from stow position when the services of the reflector are required. This option, of course, is similar to the hood latching means previously discussed in the main invention.

In the preferred embodiment of the alternative form, (see FIGS. 9*a* and 9*b*), the latch means (24) are two rounded protrusions located on either side of casing (26) and to the rear of the shafts (29) and the latch means receivers (20) are holes, or indentations, in the hood arms (22) and so located that when the hood is in stow position, the said protrusions are engaged into the said holes. An over-rideable latching action is provided by a spring-like force applied inwardly by the hood arms and included latch means receivers (holes) against the protrusions which results from the latch means receivers not being as far apart as the latch means (protrusions). During latching or unlatching, the holes simply cam over the protrusions. This configuration of the latch means and receivers is, of course, very similar to that discussed in the main invention.

In the alternative form, another optional improvement is that a hood receiving means (28) may be provided on the casing (26) to receive the hood when the hood is placed into stow position, said means to generally conform to a portion, or more, of the hood so as to provide support and protection to the hood. This option, again, is similar to the hood receiving means previously described in the main invention. In the preferred embodiment of the alternative form, the hood receiving means is a boss, or flange (28) (see FIG. 9*a*), located on the casing (26) to rear of shafts (29) and positioned such that the hood will saddle the flange when placed in the stow position, said flange conforming closely to a portion of the inner sides of both arms (22) and reflective surface (21) respectively, wherein the flange may extend rearward far enough to be adjacent the hood forward tip (36) so as to provide maximum fit and protection.

What is claimed is:

1. An adjustable light reflector for illuminating devices comprising:

(a) a collar means receiver made onto, or attached thereupon, the casing of an illuminating device, said device provided with a light emitting source, said collar means receiver having a generally cylindrical surface in order to rotatably but frictionally receive a collar means so as to allow both rotary movement and position holding capabilities of the collar means over the collar means receiver on an axis generally concentric to the collar means receiver, said axis henceforth to be referred to as the X axis, so as to provide, ultimately, a reflective surface with both rotary movement and position holding capabilities on the said X axis; and (b) a collar means being rotatably but frictionally engaged over the collar means receiver, wherein the collar means has two rotatable attaching means made thereonto, each said rotatable attaching means being rotatably but frictionally engaged with a rotatable attaching means receiver so as to provide, ultimately, the reflective surface with rotary movement and position holding capabilities on an axis established by a line connecting the rotational centers of each of the two said rotatable attaching means to the other, said axis to be henceforth referred to as the Y axis; and (c) a hood having a reflective surface on the underside of a top surface, two arms attached to either side of the top surface, said arms extending downward from the top surface, each having a rotatable attaching means receiver made onto the arm lower end, wherein each said rotatable attaching means receiver is rotatably but frictionally engaged with a rotatable attaching means, wherein the reflective surface has both rotary movement and position holding capabilities on both the X and Y axes, wherein a moving reflective surface will be presented to a portion, or more, of light rays being emitted from the illuminating device light emitting source during some portion, or more, of rotational movement of the hood on the X axis and on the Y axis, wherein the hood can be rotated on the Y axis between two limits, said limits occurring when the hood, rotated in either direction, contacts the casing, wherein one limit constitutes a hood position hereby defined as the stow position, wherein the reflector mechanism is arranged so as to be clear of the emitted light rays and also not to extend beyond the illuminating device in either direction along the X axis when in said stow position.

2. The device of claim 1 wherein the collar means receiver consists of two lands and a cylindrical groove that are made onto a portion of an illuminating device casing that is also cylindrical, wherein the longitudinal axes of both the groove and said portion of the casing are generally coincident resulting in one axis that is effectively the X axis, wherein the said portion of the casing surrounds the light emitting source, wherein the light emitting source is so arranged to emit light rays that are, in the main, in alignment with the X axis, wherein the space between the two lands effectively establishes the said groove, wherein the lands and groove, in cooperation, form a receiver for the frictional mounting, or engagement, of the collar means over the groove and between the lands in such a manner to provide both rotary movement and position holding capabilities of the collar means over the groove and on the X axis.

3. The device of claim 1 wherein the collar means is a semi-circular member, or split collar, which includes two rotatable attaching means made thereto, wherein the rotational axis of each said attaching means is in alignment with the other such that one line may be coincident with both said axes, said line establishing a Y axis, wherein each of the two said rotatable attaching means are rotatably but frictionally engaged with a rotatable attaching means receiver, each said attaching means receiver being made onto a hood arm, wherein the relative positioning of the X and Y axes are such that if the split collar is rotated over the collar means receiver, the moving Y axis will establish a single plane, said single plane being intersected by the X axis in a generally perpendicular manner, wherein the Y axis may intersect the X axis, or may be displaced away from the X axis, wherein the angular displacement of the split collar, or semi-circular member, is somewhat greater than 180° as measured by a radius line as it moves from one split collar end point to the other.

4. The device of claim 3 wherein the split collar is constructed of a material having spring-like characteristics and, in it's natural state, has a diameter somewhat less than that of the collar means receiver such that when the split collar is engaged over the collar means receiver, a spring-like frictional grip is afforded the split collar over the collar means receiver, thereby providing the split collar with both rotary movement and position holding capabilities over the said collar means receiver.

5. The device of claim 4 wherein the ends of the split collar are spaced apart sufficiently and the split collar sufficiently spring-like to allow the split collar to be disengaged from over the collar means receiver by pulling the split collar in a direction generally perpendicular to the X axis wherein the ends of the split collar will cam around the collar means receiver until disengagement is attained and wherein the split collar may be engaged over the collar means receiver in a reversal of the just described disengagement process.

6. The device of claim 5 wherein the hood is constructed of a material having spring-like characteristics such that when the hood and split collar are rotatably connected, and the split collar is disengaged from over the collar means receiver, or engaged over the collar means receiver, the hood arms will follow the spreading movement imposed by the split collar ends as said ends cam over the collar means receiver.

7. The device of claim 1 wherein the rotatable attaching means are shafts and the rotatable attaching means receiver are holes, or bearings, wherein the shafts are friction fitted, or engaged, into the bearings in order to provide resistance to any rotatable movement between said shafts and bearings so as to provide the hood with rotary movement and position holding capabilities over the said shafts and on the Y axis.

8. The device of claim 1 wherein the illuminating device casing is provided with a latch means and the hood is provided with latch means receivers so as to latch the hood into stow position.

9. The device of claim 8 wherein the casing latch means is a rounded protrusion on the casing and the hood latch means receiver is a hole, or indentation, in the hood arms for receiving the latch means.

10. The device of claim 1 wherein a hood receiving means is provided on the illuminating device casing to receive the hood when the hood is placed in stow position.

11. The device of claim 10 wherein the hood receiving means is a boss, or flange, wherein a portion, or more, of the hood will saddle the flange, said flange generally conforming to a portion of the inner sides of both hood arms and reflective surface respectively.

12. The device of claim 1 wherein the hood is provided with light shading means.

13. The device of claim 12 wherein the light shading means consists of a hood rear cover, said cover being attached on one end to the hood top surface between the hood arms and connected to each hood arm and extending away from the top surface, along with the arms, a distance less than the arm length, and also of widened hood arms that extend from the said rear cover to nearly the forward tip of the hood, and also of the hood top surface.

14. An adjustable light reflector for illuminating devices comprising:

(a) two rotatable attaching means made onto, or attached thereupon, the casing of an illuminating device, said device provided with a light emitting source, said rotatable attaching means being rotatably but frictionally engaged with rotatable attaching means receivers so as to provide, a reflective surface with rotary movement and position holding capabilities on an axis established by a line connecting the rotational centers of each of the two said rotational attaching means to the other, said axis to be referred to as the W axis; and (b) a hood having a reflective surface on the underside of a top surface, two arms attached to either side of the top surface, said arms extending downward from the top surface, each having a rotatable attaching means receiver at the lower end of the arm of each said rotatable attaching means receivers is rotatably but frictionally engaged with a rotatable attaching means, the reflective surface has both rotary movement and position holding capabilities on the W axis, a moving reflective surface will be presented to light rays being emitted from the illuminating device light emitting source during some portion of the rotational movement of the hood on the W axis the hood can be rotated on the W axis between two limits, said limits occurring when the hood, rotated in either direction, contacts the casing one limit constitutes a hood position hereby defined as the stow position the reflector mechanism is arranged so as to be clear of the emitted light rays and also not to extend beyond the illuminating device in either direction along the V axis, defined as the longitudinal axis of the casing, when in said stow position.

15. The device of claim 14 wherein the rotatable attaching means are shafts and the rotatable attaching means receivers are holes, or bearings, wherein the shafts are friction fitted, or engaged, into the bearings in order to provide resistance to any rotatable movement between said shafts and bearings so as to provide the hood with both rotary movement and position holding capabilities over the said shafts and on the W axis.

16. The device of claim 14 wherein the illuminating device casing is provided with a latch means and the hood is provided with a latch means receiver so as to latch the hood into stow position.

17. The device of claim 16 wherein the casing latch means is a rounded protrusion on the casing and the hood latch means receiver is a hole, or indentation, in the hood arms for receiving the latch means.

18. The device of claim 14 wherein a hood receiving means is provided on the illuminating device casing to receive the hood when the hood is placed in stow position.

19. The device of claim 18 wherein the hood receiving means is a boss, or flange, wherein a portion, or more, of the hood will saddle the flange, said flange generally conforming to a portion of the inner sides of both hood arms and reflective surface respectively.

20. The device of claim 14 wherein the hood is provided with light shading means.

21. The device of claim 20 wherein the light shading means consists of a hood rear cover, said cover being attached on one end to the hood top surface between the hood arms and connecting to each hood arm and extending away from top surface, along with the arms, a distance less than the arm length, and also of widened hood arms that extend from the said rear cover to nearly the forward tip of the hood.

* * * * *